United States Patent [19]

Reid

[11] 4,285,509

[45] Aug. 25, 1981

[54] FEEDER MECHANISM

[75] Inventor: Laurie M. Reid, Luthersville, Ga.

[73] Assignee: The Mead Corporation, Dayton, Ohio

[21] Appl. No.: 94,292

[22] Filed: Nov. 14, 1979

[51] Int. Cl.[3] ..... B65H 5/30

[52] U.S. Cl. ..... 271/10; 271/1; 270/54; 414/330

[58] Field of Search ..... 414/330, 123, 129; 271/1-2, 10, 21, 119, 113; 270/54-55

[56] References Cited

U.S. PATENT DOCUMENTS

| | | | |
|---|---|---|---|
| 1,031,195 | 7/1912 | Pippert | 271/2 |
| 2,079,668 | 5/1937 | Swift, Jr. | 271/10 |
| 2,267,574 | 12/1941 | Post | 271/2 |
| 3,586,312 | 6/1971 | Sammons | 271/2 |
| 4,106,762 | 8/1978 | Faltin | 270/54 |

*Primary Examiner*—Charles A. Marmor
*Attorney, Agent, or Firm*—Rodgers & Rodgers

[57] ABSTRACT

A feeder mechanism specially adapted for use in conjunction with plastic open-ended sleeve type article carriers includes a hopper (8) in which collapsed transversely folded sleeves (S) are stacked, the ends of the sleeves being folded upwardly along a transverse fold line (7) so that a minor shorter end portion (7*a*) of each sleeve is in outermost relation with respect to the hopper and to a major longer sleeve portion (7*b*), and a hollow, cylindrical rotatable feeder element (9) having a slot (10) arranged in parallel relation to its axis is disposed so that rotation of the feeder element in one direction causes the upper edge (1*a*) of the minor part of the sleeve to enter the slot so as to effect withdrawal of the sleeve from the hopper. A feed roll (23) is disposed below the feeder element and is arranged so that a sleeve withdrawn from the hopper is fed between the feed roll and the cylindrical feeder element and on to an endless conveyor (25) which operates in synchronism with the feeder element.

4 Claims, 7 Drawing Figures

Fig. 1A
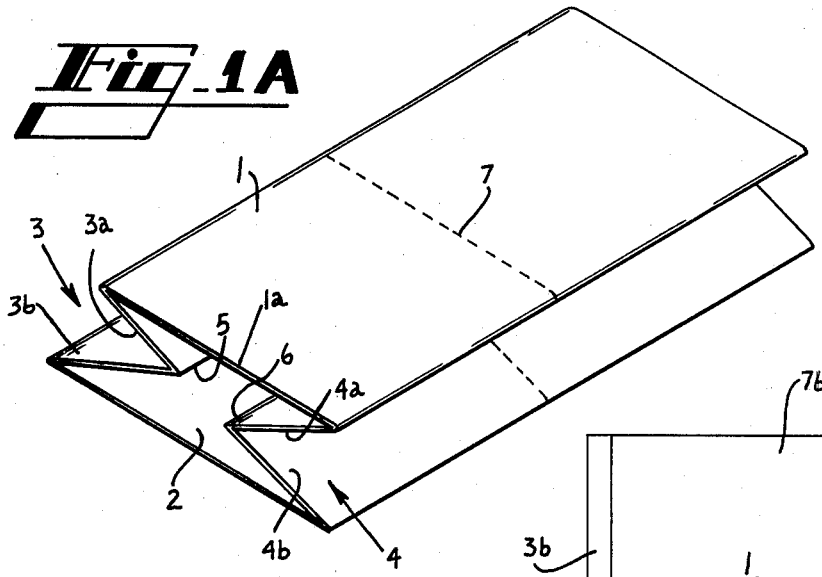
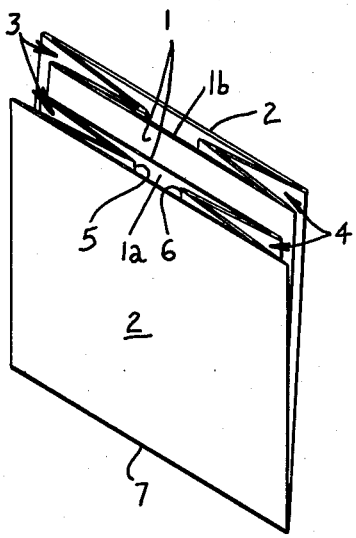
Fig. 1B
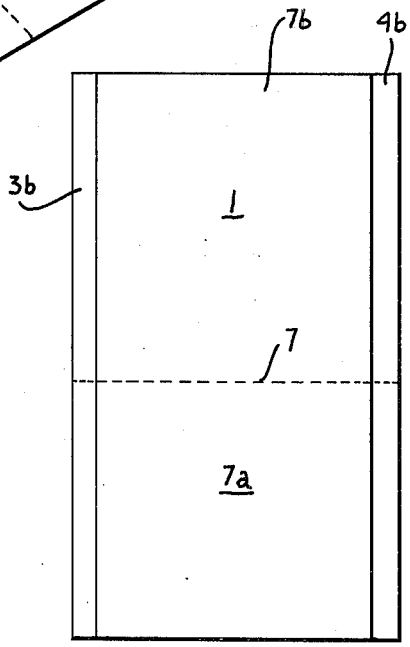
Fig. 1C
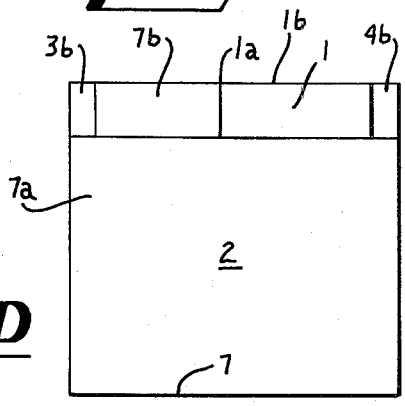
Fig. 1D

FEEDER MECHANISM

TECHNICAL FIELD

This invention relates to a feeder mechanism for use primarily with packaging machines and which effects withdrawal of collapsed sleeve type plastic cartons from a hopper for loading in a packaging machine.

BACKGROUND ART

U.S. Pat. No. 3,386,558 issued June 4, 1968 for "Feeder Mechanism" and owned by the assignee of this invention discloses a rotatable feeder mechanism utilizing suction cups for engaging and withdrawing carton blanks from a hopper. Such blanks ordinarily are formed of semi-rigid paperboard and are thus adapted for manipulation by suction cups in a desired manner.

Open-ended sleeve type plastic carriers of the type to which this invention is applicable are formed of flexible film and thus are not well adapted for manipulation by suction cups.

DISCLOSURE OF INVENTION

According to this invention in one form, openended sleeve type carriers formed of plastic film are formed with bellows folds in their side walls which enable the side walls to collapse and a transverse fold line is formed across the top, bottom and side walls which defines a minor end part and a larger major end part which when folded upwardly along the transverse fold line provide a structure which is adapted for engagement by a hollow cylindrical slotted feeder element which simply rotates to cause the slot to receive the upper edge of the minor part of the sleeve so as to effect withdrawal of the outermost sleeve from a stack of sleeves in a hopper. According to a feature of the invention a feed roll is disposed below the slotted cylindrical feeder element and is arranged in rolling frictional contact therewith so that once a sleeve is withdrawn from the hopper it is then fed between the feed roll and the feeder element in such manner that the minor part of the sleeve is gradually withdrawn from the confines of the feeder element through its slot and thence between the feeder element and the feed roll. Thereafter the sleeve may be engaged by a synchronously operable endless conveyor on which spaced pusher elements are mounted so as to convey the sleeve into a packaging machine for further manipulation and loading.

BRIEF DESCRIPTION OF DRAWINGS

In the drawings

FIG. 1A is an isometric view of an open-ended plastic sleeve of the type to which the invention is applicable and which is shown partially collapsed;

FIG. 1B is an isometric view of a fully collapsed sleeve folded on itself along a transverse fold line;

FIG. 1C is a plan view of a collapsed blank as seen from above;

FIG. 1D is a view similar to FIG. 1C of a sleeve which has been folded along a transverse fold line so as to cause the minor end part of the sleeve to overlie the major end part thereof;

BEST MODE OF CARRYING OUT THE INVENTION

Figure 1:
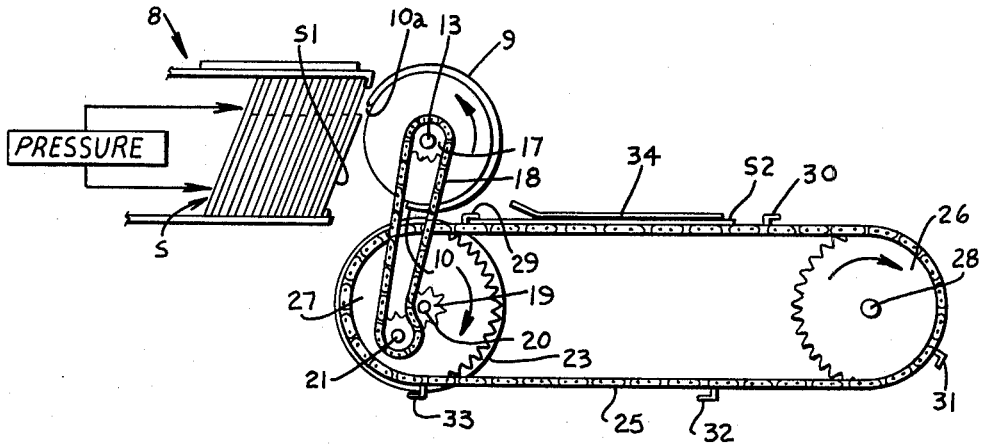
FIG. 1 is a schematic side view of a mechanism constructed according to the invention.

Open-ended sleeve type article carriers formed of plastic film as shown in FIGS. 1A, 1B, 1C and 1D include a top wall 1, a bottom wall 2 and side walls generally designated at 3 and 4. Side wall 3 includes a bellows fold line 5 which defines an upper side wall portion 3*a* and a lower side wall portion 3*b*. Similarly side wall 4 includes a bellows fold line 6 which divides side wall 4 into an upper portion 4*a* and a lower portion 4*b*. When the sleeve of FIG. 1A is completely collapsed it appears from above as shown in FIG. 1C. A transverse fold line 7 is formed in top wall 1 and in bottom wall 2 as well as in the upper and lower portions 3*a* and 3*b* of side wall 3 and in the upper and lower portions 4*a* and 4*b* of side wall 4. When the minor part 7*a* of the sleeve is folded upwardly along transverse fold line 7 the sleeve appears as shown in FIG. 1B. FIG. 1B shows the structure of FIG. 1D as an isometric view.

With the sleeves folded as represented in FIG. 1D and stacked one alongside the other, the loaded hopper structure appears as shown in FIG. 1 and is designated generally by the numeral 8. With the sleeves folded as indicated in FIGS. 1B and 1D, the upper edge portion 1*a* of the minor part 7*a* of the carton is disposed below and forwardly of the upper edge 1*b*, of the major part of top wall 1. Thus feeder means may move over edge 1*a* and behind the upper edge of the minor part 7*a* of the sleeve and may thus drive the outermost sleeve as viewed in FIG. 1 such as S1 out of the hopper 8.

Figure 2:
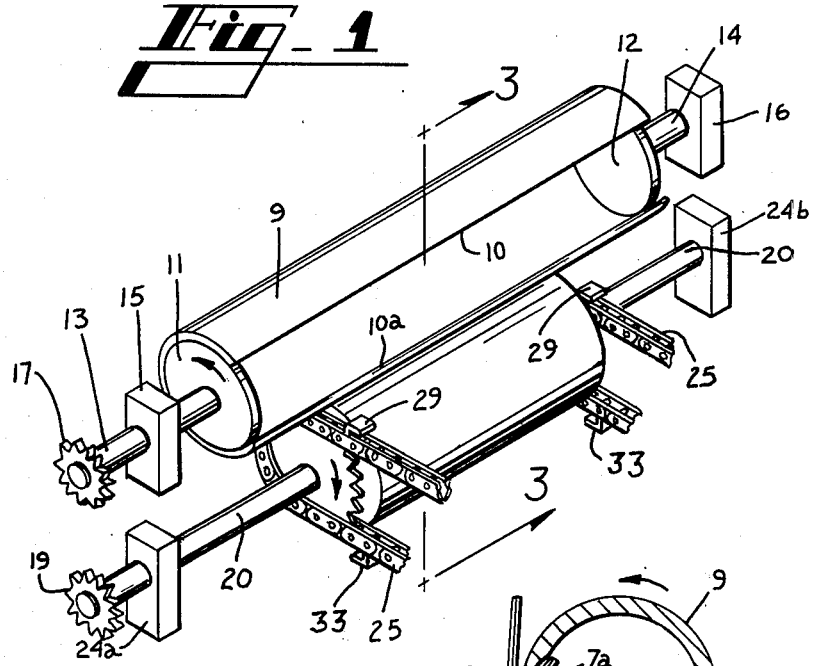
FIG. 2 is an isometric view of a slotted feeder element and of a feed roll constructed according to the invention and FIG. 3 is an enlarged cross sectional view taken along the line designated 3—3 in FIG. 2.
Figure 3:
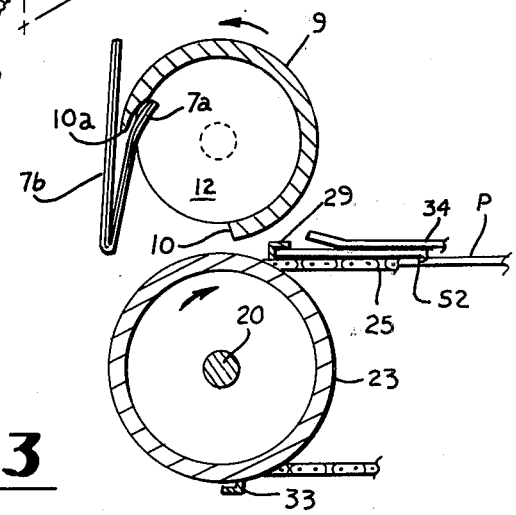

Suitable structure for engaging the minor part 7*a* of the sleeve by moving over the upper edge 1*a* thereof, according to a feature of this invention, includes a hollow cylindrical feeder element 9 having a slot 10 formed therein as best shown in FIGS. 2 and 3. Feeder element 9 is provided with end closure plates 11 and 12 to which stub shafts 13 and 14 are secured. Stub shafts 13 and 14 are mounted in bearings 15 and 16.

For the purpose of imparting rotary motion to feeder element 9 in a counterclockwise direction as viewed in FIG. 1, a sprocket 17 is rigidly mounted on stub shaft 13 and a driving chain 18 is arranged in cooperative relation with the sprocket 17 and in turn is driven by driving sprocket 19 rigidly secured to shaft 20. Chain 18 is trained about idler sprocket 21 so that rotation of sprocket 19 in a clockwise direction imparts counterclockwise rotation to sprocket 17 and to cylindrical hollow feeder element 9. Driving sprocket 26 is driven by any suitable means not shown and chains 25 rotate sprockets 27 and 19 and in turn the feeder element 9 and the feed roll 23.

With hollow feeder element 9 rotating in a counterclockwise direction as represented in FIG. 1, the edge 10*a* of slot 10 moves over the edge 1*a* of the outermost sleeve S1 and behind the outer minor part 7*a* of the sleeve to cause that part of the sleeve to enter the interior of the feeder element 9 as shown in FIG. 3. Continued rotation of feeder element 9 forces the major part 7*b* of the sleeve between the unslotted part of feeder roll 9 and the feed roll 23 disposed below feeder element 9 and rotatably mounted on shaft 20 and bearings 24*a* and 24*b*. Feed roll 23 and feeder element 9 are disposed in rolling frictional contact with the sleeve and as the operation progresses from the condition represented in FIG. 3, the folded sleeve is unfolded from its condition represented at FIG. 1D to the flat unfolded condition represented in FIG. 1C as the feeder element 9 and the feed roll 23 continue to rotate.

For the purpose of conveying a sleeve away from the region of the feeder element 9 and the feed roll 23, endless chains 25 mounted on sprockets 26 and 27 are utilized. Mounted on the conveyor chains 25 are spaced pusher elements in the form of hooks 29, 30, 31, 32 and 33. Since chains 25 are driven in synchronism with the feeder element 9, each sleeve after it is fed between feeder element 9 and feed roll 23 is unfolded into the condition represented by FIG. 1C and is lodged on fixed dead plate P disposed between chains 25. A pair of pusher elements such as 29 engage the trailing edge of the sleeve and push the sleeve toward the right as viewed in FIGS. 1, 2 and 3. The pusher elements 29–33 are arranged on chains 25 so that they enter the slot 10 in feeder element 9. The slot 10 thus affords access to space inside feeder element 9 into which the pusher elements 29–33 may move in sequence without colliding with the unslotted part of feeder element 9. Each sleeve is thus fed by conveyor chains 25 into a packaging machine for subseqent manipulation and loading. During the feeding of the sleeves such as that indicated at S2 the sleeves are maintained in flat condition by a fixed overhead guide designated by the numeral 34.

INDUSTRIAL APPLICABILITY

The feeder mechanism of this invention is well adapted for supplying open-ended collapsed plastic sleeves from a hopper at high speeds and into a packaging machine for subsequent manipulations and loading.

I claim:

1. A feeder mechanism comprising a hopper (8) having a plurality of open-ended, collapsed carrier sleeves (S) stacked in said hopper, each sleeve having a transverse fold line (7) defining an inner major part *(7b)* and an outer minor part *(7a)* each folded upwardly into flat face contacting relation with each other, a horizontal rotatable hollow cylindrical feeder element (9) having an open feeder slot (10) formed therein and disposed in parallel relation to the axis thereof, bearing means (15,16) arranged to support said feeder element adjacent said hopper in such manner that rotation of said feeder element in one direction causes the upper portion *(1a)* of said minor part *(7a)* of the outermost sleeve to move into the interior of said feeder element through said slot (10) so as to effect withdrawal of such outermost sleeve from the hopper (10), means (17, 18) for rotating said feeder element in said one direction, a horizontal, rotatable feed roll (23) disposed below said feeder element, said feed roll and said feeder element being arranged to receive sleeves (S) in sequence therebetween which are withdrawn from the hopper (8), and endless conveyor means (25) having spaced pusher elements (29–33) thereon arranged to receive said sleeves (S) in sequence from between said feed roll (23) and said feeder element (9), said slot (10) being arranged to receive and to discharge said pusher elements in sequence.

2. A feeder mechanism according to claim 1 wherein said conveyor means (25) and said feeder element (9) are coupled together for synchronous operation.

3. A feeder mechanism comprising a hopper (8) having a plurality of open-ended, collapsed carrier sleeves (S) stacked in said hopper, each sleeve having a transverse fold line (7) defining an inner major part *(7b)* and an outer minor part *(7a)* each folded upwardly into flat face contacting relation with each other, a horizontal rotatable hollow cylindrical feeder element (9) having an open feeder slot (10) formed therein and disposed in parallel relation to the axis thereof, bearing means (15,16) arranged to support said feeder element adjacent said hopper in such manner that rotation of said feeder element in one direction causes the upper portion *(1a)* of said minor part *(7a)* of the outermost sleeve to move into the interior of said feeder element through said slot (10) so as to effect withdrawal of such outermost sleeve from the hopper (8), means (17, 18) for rotating said feeder element in said one direction, a horizontal, rotatable feed roll (23) disposed below said feeder element, said feed roll and said feeder element being driven in synchronism and being arranged to receive sleeves (S) in sequence therebetween which are withdrawn from the hopper (8), and endless conveyor means (25) driven in synchronism with said feed roll and said feeder element and having spaced pusher elements (29—33) thereon arranged to receive said sleeves (S) in sequence from between said feed roll (23) and said feeder element (9), and said open feeder slot being arranged to receive said pusher elements in sequence, said endless conveyor means including rotatable sprockets coaxially arranged with respect to said feed roll.

4. A feeder mechanism according to claim 3 wherein said feed roll is shorter than said feeder element and said sprockets are of such diameter relative to the diameter of said feed roll as to cause said pusher elements to enter and move out of said open feeder slot in sequence.

* * * * *